United States Patent [19]

Creighton et al.

[11] Patent Number: 4,604,312

[45] Date of Patent: Aug. 5, 1986

[54] STRESS-FREE, EMBOSSED, ORNAMENTED TILE SURFACE COVERING AND PROCESS FOR MAKING THE SAME

[75] Inventors: Thomas C. Creighton, Manheim; William C. Dorsey, Conestoga; Walter J. Lewicki, Jr., Lancaster; Harry F. Long, Lancaster; Richard M. Ringer, Lancaster, all of Pa.

[73] Assignee: Armstrong World Industries, Inc., Lancaster, Pa.

[21] Appl. No.: 619,318

[22] Filed: Jun. 11, 1984

Related U.S. Application Data

[63] Continuation-in-part of Ser. No. 434,631, Oct. 15, 1982, abandoned.

[51] Int. Cl.[4] ..... B32B 31/00; B26D 5/00; B31F 1/20; D04H 1/00

[52] U.S. Cl. ..... 428/137; 428/203; 428/204; 156/252

[58] Field of Search ..... 428/203, 204, 131, 137, 428/133; 156/252

[56] References Cited

U.S. PATENT DOCUMENTS

| | | | |
|---|---|---|---|
| 1,861,663 | 6/1932 | Lahey | 428/137 |
| 2,558,791 | 7/1951 | Smith et al. | 156/238 |
| 2,991,216 | 7/1961 | Hsu et al. | 156/273.7 X |
| 3,658,617 | 4/1972 | Fearnow et al. | 156/238 X |
| 3,725,172 | 4/1973 | Fekete et al. | 156/252 |
| 3,804,657 | 4/1974 | Eyman et al. | 428/203 X |
| 4,126,727 | 11/1978 | Kaminski | 428/204 X |
| 4,289,559 | 9/1981 | Murphy | 156/238 |
| 4,312,686 | 1/1982 | Smith et al. | 156/235 X |

*Primary Examiner*—George F. Lesmes
*Assistant Examiner*—Nancy A. B. Swisher

[57] ABSTRACT

A stress-free embossed, ornamented surface covering, suitable for use as a floor or wall tile, is made by: providing a decorated resinous film on a release carrier, with the decorated surface of the film facing away from the carrier; providing on a release carrier a pre-formed, low-density, reinforced, porous thermoplastic base material, which may include hollow, non-thermoplastic particles; interfacing the decorated surface of the film with the top surface of the base material; perforating the film, after removal of the release carriers; and, subjecting the structure to high frequency electrical energy and pressure in a flatbed press having a cooled embossing plate and a cooled back-up plate, to emboss the structure, fuse the resins and render the film substantially impermeable. The film may be die cut in register with the decoration thereon while it is on the release carrier, without cutting the carrier, prior to lamination of the film to similarly cut and shaped pieces of the base material or, the base material and the decorated film thereon may be simultaneously cut in register with the decoration after removal of the release carriers. An adhesive coating and a releasable paper may be applied to the back of the product to facilitate installation thereof on a surface upon removal of the paper.

6 Claims, 2 Drawing Figures

STRESS-FREE, EMBOSSED, ORNAMENTED TILE SURFACE COVERING AND PROCESS FOR MAKING THE SAME

CROSS-REFERENCE TO RELATED APPLICATION

This application is a continuation-in-part of application Ser. No. 434,631 filed Oct. 15, 1982 abandoned, filed in the name of Thomas C. Creighton, et al., entitled "Stress-Free, Embossed, Ornamented Tile Surface Covering and Process for Making the Same."

BACKGROUND OF THE INVENTION

This invention relates generally to an embossed, stress-free, tile surface covering and process for forming it. More particularly, the invention relates to such a tile surface covering having deeply embossed areas and an improved replication of the embossed surface of the embossing plate.

THE PRIOR ART

It has been previously known to produce embossed resinous surface coverings wherein the embossing was achieved chemically or mechanically. It has been further known to provide decorative designs on such surface covering by applying variously-colored inks to either the top surface of the base material, or to a film wear layer thereon, prior to, or subsequent to, the embossing of the structure. However, there have been problems in the past involving distortion of the material and the design thereon, registration of designs and embossing, the inability to obtain full replication of embossing surface detail, development of stresses in the product created during the formation thereof, and dimensional stability of the product, in the use of mechanical embossing where different depths of embossing combined with full replication of the embossing surface was desired.

U.S. Pat. No. 3,562,059 relates to a method of decorating a plastic foam form by placing the printed face of the polymer film, blanked to the shape of the foam form, against the foam, covering the film with a woven Teflon cloth, applying heat and pressure to the face of the cloth, and then stripping the cloth from the film.

U.S. Pat. No. 3,180,776 relates to the ornamentation of plastic articles by forming a color support blank of incompletely cured, filled, resinous material, printing decorations thereon with appropriate inks, and subjecting the blank to a high frequency heat treatment to harden the inks. A transparent incompletely cured, filled, plastic sheet of similar resinous material may then be placed on the previously formed blank, with the printed surface on the color support blank in contact with the transparent sheet. The product is formed by molding and fusing the material using heat and pressure.

U.S. Pat. No. 3,024,154 relates to the art of embossing thermoplastic film which comprises, heating a relatively thick sheet of thermoplastic material to a temperature above its softening temperature and that of the film, bringing one surface of the film in a relatively cool condition into contact with the surface of the thicker sheet, moving the film and sheet together between a cooled, indented embossing element and a backing element, to press the film and sheet into the indentations in the embossing element, and then cooling the composite structure.

U.S. Pat. No. 3,325,332 relates to a method of laminating a relatively thick plastic film to a compatible plastic foam by heat-softening the foam and pre-heating only the contacting surface of the film and then pressing the film and foam together.

The problems previously indicated herein have not been satisfactory solved by the foregoing prior art.

SUMMARY OF THE INVENTION

This invention relates to a stress-free, embossed, ornamented surface covering which may be in the form of a floor or wall tile and process for making it, wherein a transparent, perforated, thermoplastic film having decorative design portions on one surface thereof, is placed on the top surface of a porous, low-density thermoplastic base material, with the decorated surface of the film being interfaced with the top surface of the base material.

The porous base material may be a lightly sintered resinous dryblend structure having hollow non-thermoplastic particles therein and may be reinforced with a material such as glass scrim. The term "capable of being permeated" as used herein in describing the thermoplastic film is intended to indicate that the film either is initially permeable, or that it may be rendered permeable at a later stage in the process prior to the embossing of the surface covering and fusion of the resins therein. The film may be cut to the desired tile dimensions in register with the design portions thereon while it is on the release carrier without cutting the carrier, interfaced with the top surface of a piece of the base material of similar size, and the release carrier removed, or, the film may be interfaced with the top surface of a sheet of the base material, and the film and base material cut in register with the design on the film simultaneously, after removal of the release carrier. Adhesive may be applied to the base material-contacting surface of the film, or, the adhesive may be included in the ink used for the decoration on the film.

When laminating the film to the base material, heat at a temperature sufficient only to activate the adhesive is used, together with light pressure, to assure bonding of the film to the base material. In both cases, the base material with the decorated film thereon, is then subjected to high frequency electrical energy and pressure in a flatbed press having a cooled embossing plate and a cooled back-up plate, to emboss the structure, fuse the resins and render the film impermeable. The film may be vinyl, and is perforated to allow air trapped in the deeper recesses of the embossing plate to escape therethrough. The perforations are sealed during the embossing and fusing of the resins in the composite structure. The printed image is completely undistorted and in exact registration with the embossing.

The prior art problems previously indicated herein are solved by the present invention. Since the base material is first, a porous low density material with hollow, non-thermoplastic particles therein, it can be compressed vertically in a flatbed press with a minimum of lateral flow. This permits deeper, more clearly defined embossing and less distortion in the product. The process further substantially eliminates the distortion of the decoration on the film, and the base material which is normally encountered when using a flatbed embossing press, especially with low density compositions that are difficult to heat and cool, by allowing escape of air. This invention further controls distortion through the use of high frequency heating, and compositions which are receptive thereto, coupled with cooling of the embossing and back-up plates of the press, so that the materials can be heated quickly to a temperature sufficient for embossing while avoiding distortion of the film ornamentation under pressure from entrapped air. Lack of distortion of the ornamentation of the film in the process of this invention, of course, makes it possible to easily emboss in register with the decoration on the film. As is commonly known, thermoplastic films are not dimensionally stable when heated sufficiently so that they may be embossed. They tend to expand or contract differently in different parts of the sheet.

The avoidance of heating the materials to high temperatures prior to the final embossing and fusion step, substantially eliminates the build-up of stress in the materials. This, together with the flat, cooled bottom surface of the embossing press, the inclusion of the reinforcing glass scrim, and the use of high frequency heating, produces a product that is dimensionally stable, stays flat, and doesn't curl when subjected to conditions of heat and moisture.

DESCRIPTION OF THE PREFERRED EMBODIMENTS

Figure 1:
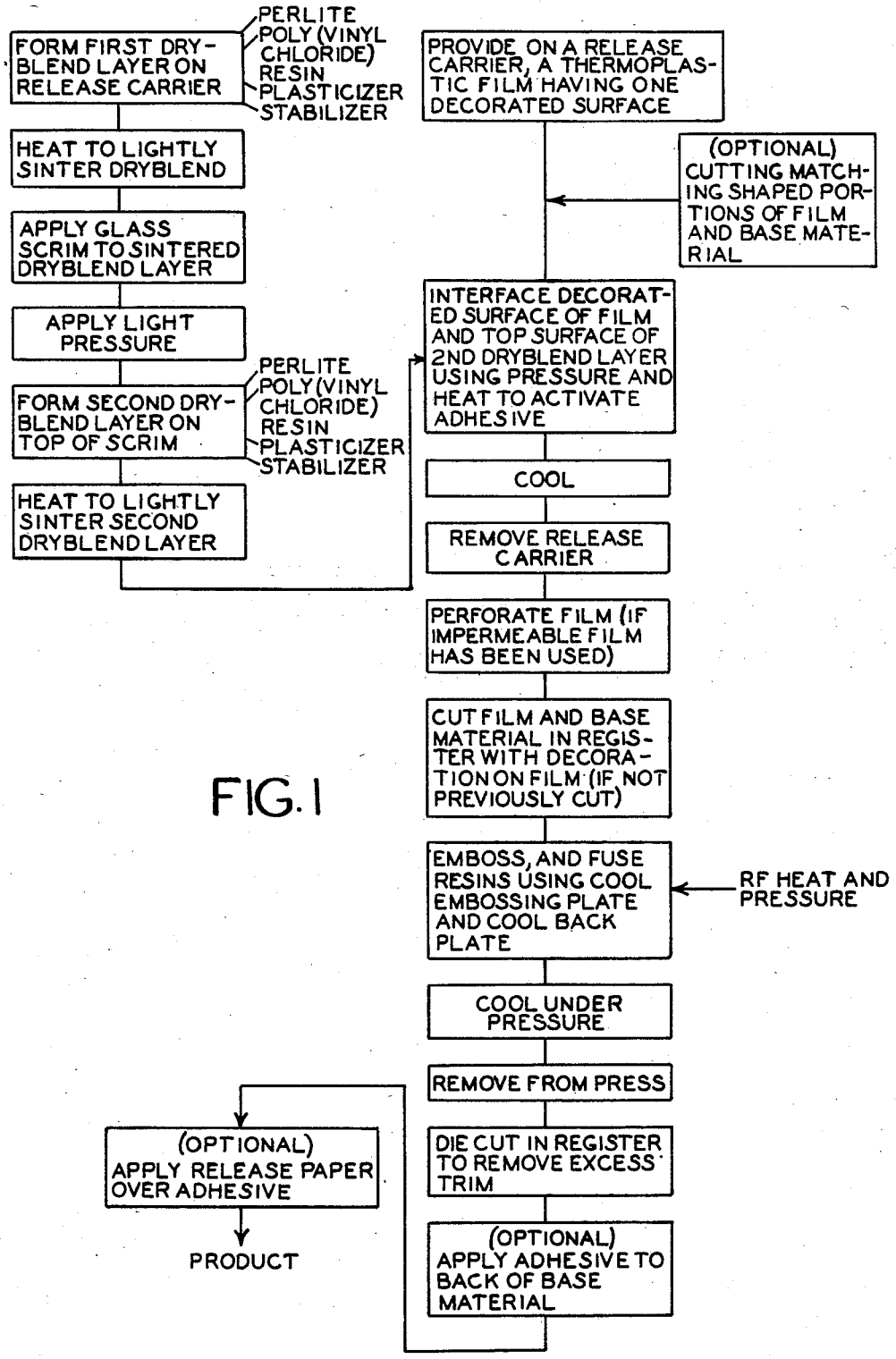
FIG. 1 is a flow diagram depicting the steps following in carrying out the embodiments of the process of this invention.

As indicated by the flow diagram of FIG. 1, there are two embodiments of the invention.

In the first embodiment of the invention, the manufacturing process begins with the formation of a porous low density base material. As indicated in the flow chart of FIG. 1, a first dryblend layer is formed on a release carrier. In the formation of the base material a mixture of resinous dryblend particles and expanded perlite is prepared. The dryblend is in the form of a free-flowing homogeneous mixture of unfused thermoplastic resin particles, including liquid vinyl plasticizer, filler, pigment, and vinyl stabilizer.

Poly(vinyl chloride) is the preferred resin for use in forming the surface covering of the present invention, although copolymers of vinyl chloride with minor proportions of other materials such as vinyl acetate, vinylidene chloride, other vinyl esters such as vinyl proprionate, vinyl butyrate as well as alkyl substituted vinyl esters may be used.

Other thermoplastic resins which are receptive to high frequency heating or which can be combined with materials receptive to high frequency heating may also be used. These may include, for example, polyethylene, polyurethanes, polyesters, polyamides, polyacrylates (e.g., polymethyl methacrylate) as well as polymers derived from acetates and cellulose esters.

The free-flowing mix of resin, plasticizer, stabilizer, pigment, and filler may be readily formed by adding the resin, for example a homopolymer of vinyl chloride in the form of discrete particles, along with the vinyl resin plasticizer such as Di-2-ethylhexyl phthalate, butylbenzyl phthalate, epoxidized soybean oil, or tricresyl phosphate, filler, pigment, and suitable vinyl resin stabilizers to a mixer, or blender, such as a Henschel blender, where they are mixed under moderate heat, for instance, at a temperature of about 160°–220° F., for a period of time to insure that the liquid plasticizer and the stabilizer become absorbed and thus diffused throughout the resin particles and the remaining ingredients adsorbed thereon. Care is taken so that no fusion of the resin particles occurs during the mixing, and the temperature must be kept below that at which such would occur. Generally speaking, the addition of fillers and pigments to the mix may be made either initially, at the end of the mixing cycle when the resin particles remain relatively warm, or after the dryblend particles have been mixed and cooled.

The dryblend composition useable in the present invention may include the following ingredients in the indicated ranges, based on 100 parts of resin:

| Ingredients | Parts by weight |
|---|---|
| Poly(vinyl chloride) dispersion grade resin - Average Mw 70,000–80,000 | 50–100 |
| Poly(vinyl chloride) blending grade resin average MW 33,000–46,000 | 50–0 |
| Dioctyl phthalate, plasticizer | 25–75 |
| Organatin stabilizer | 1–3 |
| Titanium dioxide paste (50% in DOP) | 0–5 |
| Limestone (50 mesh) filler | 0–200 |

The dryblend/perlite mix used in the present invention is formed by a simple mixing or tumbling together of the two dry materials until a uniform blend is obtained. About 90 parts by weight of the dryblend and about 10.5 parts by weight of the perlite are used.

The quantity of perlite used in the composition, however, can be varied considerably, but the upper limit is determined by the ability of the composition to hold together in a useful manner after heating and consolidation. This upper level is affected by the particle size of the perlite used, and, since we add or mix our proportions by weight, the density of the perlite particles. The perlite particles preferred for use in the present invention is Spherepack MM-100, sold by Patentech Corporation, Shepherd Grove, Ill. The particle size of the perlite useable in the present invention ranges from about 35 to 850 microns. The average particle size for the Spherepack MM-100 perlite is about 60 microns. The effective range of the quantity of perlite useable would be between 2 and 20 percent by weight when combined with a quantity of dryblend in the range of from about 98 to 80 percent by weight. The preferred range of the perlite used would be about 5 to 15 percent by weight, and the most preferred range would be about 8 to 12 percent by weight. The levels of other types of perlite, for example, the 3.5 and 10 pound/cubic foot bulk density materials, may differ due to their larger particle size and/or density. Although it is preferred that the base material should be formed using expanded perlite as the hollow particles, it is contemplated that other hollow particles of, for example, glass, ceramic, or organic materials could be used within the scope of the invention.

A layer of the perlite-containing dryblend mixture about 100 mils thick is then formed on a release-surfaced carrier and heated to a temperature sufficient to cause surface portions of the resinous particles to melt slightly and stick together at their points of contact with each other. A reinforcing layer of non-woven glass scrim is then placed on the perlite-containing dryblend layer so formed and light consolidating pressure is applied thereto. The glass scrim may have a basis weight of about 10 g–50 g/m$^2$. Alternatively, the reinforcing layer may comprise woven or non-woven fibers of glass, polyester, polyamide, and the like. Another layer of similar thickness of the dryblend and perlite mixture is formed on top of the scrim and this second layer is then heated to a temperature similar to that used in forming the first layer and slight consolidating pressure is again applied. The resulting base material is now in a friable but suitable condititition to be handled for further processing. It is also porous, allowing it to be subsequently compressed in a vertical direction with minimum lateral flow. It is also receptive to high frequency energy.

The preferred reinforced, sintered dryblend and expanded perlite composite is a unique porous structure in which each individual pore is reinforced by the rigid cellular structure of the individual expanded perlite particle. The collective effect of the many reinforced pores contributes to a great extent to the necessary dimensional stability and light weight of the product, while at the same time still allowing crushability during the embossing step with limited lateral flow.

Although it is preferred that the base material should be as described, other porous structures, such as open-celled thermoplastic resin foams (e.g., vinyl foam), thermoplastic matting, and the like may be used; however, results generally are not as good since print distortion, material extrusion, and structural collapse may occur during subsequent processing operations.

A dimensionally stable release carrier is then provided with a resinous thermoplastic film preferably about 4 mils thick and having ornamented design portions on the surface thereof facing away from the carrier. The film may, however, range from about 0.1–15.0 mils in thickness, and, at this point, may or may not be perforated. The film may be cast, extruded, or laminated onto the release carrier and, the design or decoration may be applied either prior to, or subsequent to, application of the film to the release carrier. Also, it is recognized that the decoration may be applied to the top surface of the base material and a non-decorated film or a coating applied thereover. The film preferably comprises a poly(vinyl chloride) resin and/or copolymers thereof (e.g., vinyl chloride and acrylic monomers and copolymers such as ethylene-acrylic acid). However, other thermoplastic materials such as polyesters, polyurethanes, polyamides, polyolefins (e.g., polyethylenes), polyacrylates, and the like could be used in the invention. Adhesive may be applied to the decorated surface of the film or, the adhesive may be in the ink or may be combined with the ink.

The film is then die cut to the desired dimensions in register with the design while the film is on the release carrier, but without cutting the carrier. The base material is cut into shapes corresponding to those of the cut portions of the film.

The decorated surface of the cut portions of the film are then interfaced with the top surface of the shaped portions of the base material, the release carrier is removed and the film is perforated if it has not already been perforated. The die-cut film pieces may be preheated to only warm the adhesive so that lamination can be carried out at a relatively low temperature. The pieces of base material may also be pre-heated, but not all the way through. The composite structures so formed are then put into a flatbed press comprising a cooled deep embossing plate and a cooled flat back plate. High frequency energy is applied after the press is closed. The temperature of the material goes from ambient temperature to about 350° F. The high frequency power is then turned off and the pieces are allowed to sit under pressure for about 4 to 20 seconds. The perforations in the film seal shut, and the film becomes impermeable. The press is then opened, the pieces removed and die-cut in register. Adhesive is applied to the back of the pieces and release paper is applied.

In the second embodiment of the invention the same material and procedures are used except that the film and base material are die-cut simultaneously in register with the design portions on the film, after the design-bearing surface of the film has been interfaced with the top surface of the base material, and after separation of the release carrier from the film.

The following examples are given for purposes of illustration, but the invention is not limited to these examples. All parts and percentages are by weight unless otherwise specified.

EXAMPLE I

In forming the base material for the surface covering of the present invention, dryblend granules were prepared by mixing the following components together in a conventional Herschel dryblending apparatus through a heat history from ambient conditions to 220° F. to ambient conditions, using the following ingredients in the indicated ranges:

| Ingredients | Parts by Weight |
|---|---|
| Poly(vinyl chloride) Dispersion Grade Resin | 66.6 |
| Poly(vinyl chloride) Blending Grade Resin | 33.4 |
| Dioctyl phthalate | 25–75 |
| Organotin Stabilizer | 2 |
| Titanium Dioxide Paste (50% in DOP) | 2 |
| Limestone (50 Mesh) Filler | 100 |

The dryblend granules formed as above were then mixed with perlite particles in the following proportions:

| | Parts by Weight |
|---|---|
| Dryblend particles | 90 |
| *Perlite (Spherepack MM-100) | 10.5 |
| | 100.5 |

*A low density, hollow silica glass particle available from Patentech Corporation, Shepherd Grove, Illinois.

The above dry materials were mixed together by a simple tumbling operation until a uniform blend was obtained.

The dryblend mixture was deposited on a release-surfaced carrier to form a uniform layer of about 100 mils thick. Heat was then applied via infra-red irradiation of the top surface and electric heating of the lower platen for a period of about 2 minutes to bring the mixture to a temperature of about 375° F. to cause partial melting of surface portions of the dryblend granules and cause them to stick together at their points of contact. A sheet of non-woven glass scrim having a basis weight of about 35 g/m$^2$ and having linear dimensions similar to those of the dryblend layer was then placed thereon and slight consolidating pressure applied by passing the structure through a roll laminator.

Another layer of the same dryblend mixture similar in thickness to that of the first layer was deposited onto the glass scrim covering thereon and similarly heated and slightly consolidated. After cooling, the composite sheet, which was approximately 100 mils thick, was cut into about 7 by 7 inch tile size portions which were low density, porous, reinforced and in a suitable condition for handling and further processing procedures.

A 4 mil poly(vinyl chloride) coating was applied to a 1.42 mil thick polyester release carrier and heated to an interface temperature of about 290° F. The resulting film was then printed with vinyl inks in a decorative pattern. An acrylic type lacquer having the following composition was then applied to the decorated surface of the film to assure good bonding of the film to the base material.

| | Parts by Weight |
|---|---|
| *A21LV Resin | 13 |
| Ethyl Acetate | 43 |
| Methyl Ethyl Ketone | 13 |
| | 69 |

*A methyl methacrylate resin available from Rohm & Haas, Philadelphia, Pennsylvania.

The decorated film was then cut into shapes and sizes corresponding to those of the base material without cutting the release carrier. The decorated surface of the film was then interfaced with the top surface of the pieces of the base material which were pre-heated to warm the top surface portion only. Heat was applied from a silicone roller heated at about 400° F. to soften the adhesive on the decorated surface of the film, and light pressure was applied by a roll laminator to bond the film to the base material. After cooling, the release carrier was removed. The decorated film was then perforated using a pin roll to provide a plurality of openings spaced about 5/16" apart.

The composite structures were then placed in a flat-bed press having water-cooled embossing and back-up plates. High frequency electrical energy was applied to fuse the resins in the structures which were then embossed by the downward pressure exerted by the embossing plate. The perforations sealed shut. The products were then allowed to cool under pressure, removed from the press, and die-cut in register to remove excess trim. A water-based acrylic type adhesive having the following formulation was then applied to the back of the finished pieces to facilitate their subsequent attachment to a surface such as a wall or floor:

| | Parts by Weight |
|---|---|
| *Polyacrylic Emulsion (UCAR174) | 98.62 |
| **Sodium Polyacrylic Solution (Alcogum 6940) | 1.31 |
| ***1,2-Benzisothiazolin-3-one (Proxel CRL) | 0.7 |

*available from Union Carbide, Danbury, Connecticut
**available from Alco Chemical Co., Philadelphia, Pennsylvania
***available from ICI America, Inc., Wilmington, Delaware A release-coated paper was then applied onto the adhesive. The paper is easily removable at the time of installation of the product on a substrate. The product is a stress-free, decorated, embossed surface covering having non-curling tendencies.

EXAMPLE II

A stress-free, embossed, ornamented surface covering was formed by using the same base material dry-blend—perlite mixture and procedures as in Example I. The decorated film was also provided using the same materials and procedures as in Example I. In the formation of this surface covering, however, neither the ornamented film nor the base material was cut prior to lamination of the film and base material. In this procedure, the decorated surface of the film was interfaced with the top surface of the base material, and heat and pressure was applied to activate the adhesive. After cooling, the release carrier was removed, the film perforated and the film and base material cut simultaneously in register with the design on the film.

The embossing of the structure, fusing of the resins, sealing of the perforations, die-cutting to remove excess trim, and application of adhesive and release paper to the back of the product were done in the same manner and using the same materials as in Example I.

Figure 2:
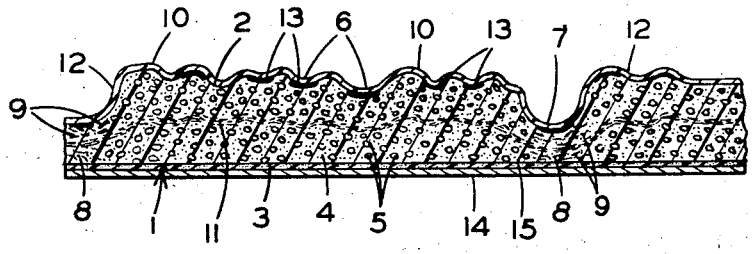
FIG. 2 is an enlarged cross-sectional view of a portion of the surface covering formed by the process of this invention.

As shown in FIG. 2 of the drawings the surface covering produced by the foregoing process comprises a main body portion layer 1 having a top surface 2 and a bottom surface 3 and comprises a fused matrix of resinous dryblend 4 with hollow non-thermoplastic particles 5 therein. The top surface 2 of the layer 1 has depressed portions 6 and 7 therein, depressed portions 7 being substantially deeper than depressed portions 6 and containing fused resin 8 in a substantially continuous phase with substantially completely crushed non-thermoplastic particles 9 therein. Raised portions 10 are provided on the top surface 2 of the main body layer 1 and are elevated with respect to both the depressed portions 6 and 7. The raised portions and the shallow depressed portions 6 comprise fused resin in a substantially non-continuous phase with non-crushed and substantially only partially crushed non-thermoplastic particles therein. A reinforcing non-woven glass scrim 11 is provided intermediate top and bottom surfaces 2 and 3 of the main body portion layer 1. A substantially impermeable transparent fused resinous wear layer 12 is bonded to the top surface 2 of the layer 1, and ornamentation 13 is provided between the wear layer 12 and the top surface 2 of the main body layer 1. A releasable covering 14 is secured by adhesive coating 15 to the bottom surface 3 of the surface covering to, upon removal of the covering 14, facilitate installation of the surface covering to a substrate such as a wall or floor. The surface covering has a sealed and impermeable wear layer having a printed decoration in exact register with the embossing and is substantially stress free and has non-curling tendencies; is relatively easier and more economical to produce; and provides an improved, more aesthetically appealing product having improved stability.

What is claimed is:

1. A process for making a stress-free, dimensionally stable, embossed surface covering comprising:

(a) providing a resinous thermoplastic transparent top layer having a plurality of openings extending through the thickness thereof and adapted to allow passage of air therethrough during a subsequent embossing and fusion step, said resinous thermoplastic top layer being a vinyl film having a design on one surface thereof;

(b) providing a low density porous thermoplastic base layer comprising a pre-consolidated resinous dry-blend having preformed, hollow, non-thermoplastic particles homogeneously distributed therein;

(c) applying the resinous top layer onto the base layer;

(d) placing an embossing plate with deep recesses adjacent the resinous top layer, wherein the embossing plate is part of a flatbed press having a cooled embossing plate and a cooled backing plate;

(e) embossing the composite structure by pressure which presses the embossing plate into the surface of the composite structure having the resinous top layer by applying high frequency energy to the structure after the press is closed;

(f) permitting air trapped in the deep recesses of the embossing plate to escape through the openings of the top layer into the porous base layer; and (g) then heating the composite structure under pressure to permit the film to seal shut its perforations and then to fuse the base layer without forcing base layer material into the openings of the top layer.

2. The process according to claim 1, wherein the resinous thermoplastic layer is a film selected from the group consisting of polyamides, polyacrylates, polyurethanes, polyester, and polyethylenes.

3. The process according to claim 1, wherein the resinous thermoplastic film is provided on a release carrier, the design on the film is on the surface thereof which faces away from the release carrier, and wherein the design-bearing film surface is interfaced with the top surface of the base material and the release carrier is separated from the film prior to the embossing and fusion step.

4. The process according to claim 3, wherein a shaped portion of the resinous thermoplastic film is cut in register with the design portions thereon while it is on the release carrier without cutting the carrier, and prior to interfacing the design-bearing surface of the film with the top surface of the base material, and wherein the base material is provided in a size and shape corresponding to that of the cut portion of the film.

5. The process according to claim 3 including the step of cutting the film and base material in register with the design portions on the film after the design-bearing film surface has been interfaced with the top surface of the base material and after separation of the release carrier from the film.

6. The process according to claim 1, wherein the base layer is about 100 mils thick and the top layer is about 4 mils thick.

* * * * *